United States Patent [19]

Landis

[11] Patent Number: 4,685,264

[45] Date of Patent: Aug. 11, 1987

[54] CONCRETE SLAB-BEAM FORM SYSTEM FOR COMPOSITE METAL DECK CONCRETE CONSTRUCTION

[75] Inventor: Donald H. Landis, Pittsburgh, Pa.

[73] Assignee: Epic Metals Corporation, Rankin, Pa.

[21] Appl. No.: 849,795

[22] Filed: Apr. 9, 1986

[51] Int. Cl.[4] ..... E04B 1/00

[52] U.S. Cl. ..... 52/252; 52/326; 249/28; 249/50

[58] Field of Search ..... 52/252, 319, 326, 335, 52/336; 249/28, 50

[56] References Cited

U.S. PATENT DOCUMENTS

| | | | |
|---|---|---|---|
| 1,068,544 | 7/1913 | Stewart | 52/319 X |
| 1,073,906 | 9/1913 | Kahn | 52/329 |
| 1,200,484 | 10/1916 | Graham, Jr. | 52/326 X |
| 1,498,665 | 6/1924 | MacIvor . | |
| 1,550,810 | 8/1925 | Jabelonsky | 52/329 X |
| 1,628,385 | 5/1927 | Bauer | 249/28 X |
| 1,719,528 | 7/1929 | Beckley et al. . | |
| 1,753,496 | 4/1930 | Barton . | |
| 1,871,976 | 8/1932 | Fraber . | |
| 1,999,783 | 4/1935 | Riesbol | 249/50 X |
| 2,916,909 | 12/1959 | Miller . | |
| 3,037,259 | 6/1962 | Dave . | |
| 3,389,521 | 6/1968 | Gregori . | |
| 3,520,508 | 7/1970 | Sewell et al. . | |
| 3,562,979 | 2/1971 | Ali-Oglu . | |
| 3,619,959 | 11/1971 | Parker | 52/326 X |
| 3,640,040 | 2/1972 | MacLean . | |
| 3,708,929 | 1/1973 | Estes et al. | 52/98 |
| 3,744,945 | 7/1973 | Metrailer . | |
| 3,845,930 | 11/1974 | Metrailer . | |
| 3,967,426 | 7/1976 | Ault et al. | 52/252 |
| 3,999,341 | 12/1976 | Stout . | |
| 4,227,672 | 10/1980 | Cunningham . | |

FOREIGN PATENT DOCUMENTS

| | | | |
|---|---|---|---|
| 2632961 | 7/1977 | Fed. Rep. of Germany | 52/336 |
| 1016420 | 11/1952 | France | 249/28 |
| 1257858 | 2/1961 | France | 52/319 |

*Primary Examiner*—William F. Pate, III
*Assistant Examiner*—Creighton Smith
*Attorney; Agent, or Firm*—Arnold B. Silverman

[57] ABSTRACT

A metal "U" shape channel form is used to form a concrete beam, and has two laterally opposed outwardly extending horizontally disposed flanges with two supporting areas arranged in a stepped fashion for selectively supporting a metal deck or both a metal deck and plywood between the span of adjacently arranged channel forms used to form a slab therebetween, which slab may be composite in that the formed slab integrally includes a metal deck. A "U" shape shoring head of complementary shape to the channel form is mounted on a shoring frame to hold the channel form in place for the pouring of the concrete, and a shoring head can be used with a structural member arranged to support the metal deck of variable spans for slabs of variable dimensions in the available space.

17 Claims, 12 Drawing Figures

CONCRETE SLAB-BEAM FORM SYSTEM FOR COMPOSITE METAL DECK CONCRETE CONSTRUCTION

BACKGROUND OF THE INVENTION

1. Field of the Invention

The invention relates to metal forms and a shoring head mounted on a shoring frame supporting the metal form, more specifically, the invention relates to a form for receiving concrete and a cooperating complementary shoring head for metal deck concrete composite floors and roofs.

2. Description of the Prior Art

In building constructions, concrete beams and slabs comprising a roof or floor, may be integrally cast as a unit through a complex formwork. Such formworks frequently have wooden beam forms with wooden or metal decks spanning the beam forms, or such form work frequently is of the "metal pan convention form" consisting of a plurality of steel forms or metal pan members. Depending on the desired length for the slab between these metal pan members, the metal pan members may be interconnected or spaced-apart with a deck bridging the spaced-apart pans. The area between the pan members has a greater depth than that above the pan members and in the pouring of the concrete, the beam is formed in this greater depth section, whereas the slabs are formed integrally with the beams in the lesser depth concrete section. Some "metal pan convention forms" are exemplified in U.S. Pat. Nos. 1,073,906; 1,550,810; and 3,708,929.

The advantageous use of corrugated metal deck members, having alternating ribs and valleys and an overlying layer of concrete with which it coacts in a composite manner has been employed advantageously in roofs and floors.

There has evolved a design in composite slabs which allows longer longitudinal spans. This has been disclosed in U.S. Pat. No. 3,967,426, issuing on July 6, 1976. A metal deck has a plurality of longitudinally oriented hollow ribs and a flat panel section disposed between adjacent ribs. At predetermined locations, segments of the metal deck are interrupted to create a downwardly extending slab beam oriented generally transversely with respect to the hollow ribs. In this system, wooden forms may still be used to form the concrete beam.

In the above designs for forming a series of concrete slabs alternating with a series of concrete beams, complex formworks are involved, which, in turn, require a complex scaffolding design to support these formworks. Safety regulation standards limit the length of the slab between the beams, and until the teachings of U.S. Pat. No. 3,967,426, the range for the length of the slab was substantially less than that given by the composite deck of the U.S. Pat. No. 3,967,426. More beams or joists were required to support the lesser length for the slabs. Arrangements for forming a slab-beam floor or roof assembly requires the complex formworks and scaffolding arrangements, for these present methods for forming a slab-beam system results in high labor costs. In addition, intensive labor is involved in erecting and removing these various formworks and their related scaffolding designs.

In some instances, disassemblage of these present slab-beam systems is such that the beam form may not be reusable in that the several wooden parts may also be disassembled.

There remains, therefore, a substantial need for an economical means of forming a concrete slab-beam system so as to permit greater design flexibility of building design and improved economy of constructing the slab-beam system. In addition, there is a particular need for such slab-beam systems which simplify the formwork design and scaffolding or shoring frames for supporting the formwork thereby lessening labor costs thereof. There is a need to simplify a beam form which is unitary and reusable and designed to support a structural member for forming a slab, which slab may include a metal deck exemplified by the type disclosed in the above mentioned U.S. Pat. No. 3,967,426. There is a need to provide a beam form, and a shoring head that are designed so that the beam form sits directly on the shoring head, of the shoring frame. There is a need to decrease the need for labor and thus, costs, in the erecting and disassemling stages of the form works and scaffolding, and to provide a slab-beam system which greatly increases the efficiency of forming concrete slab-beam and floors and roofs.

SUMMARY OF THE INVENTION

The above described needs have been met by the formwork and shoring frame of the present invention. In a formwork design for forming the slab-beam system a metal beam form is in a generally "U" configuration; and in a shoring frame design, a "U" shape shoring head complements and supports the metal beam form. The metal beam form has two laterally opposed outwardly extending horizontally disposed support means near the opening of the beam form. Preferably the support means has two surfaces, each arranged in a stepped fashion; i.e. one surface area is lower than the other surface area. Depending on the type of concrete slab which is to be formed, the structural member longitudinally spanning two adjacent beam forms can be supported either by the upper or the lower surface area. The support means of the beam form may consist of either a double stepped flange unit or a single flange unit supporting a support member which provides a surface area which may support the structural member. If desired, the beam form can be used in conjunction with a single beam as distinguished from a pair of adjacent beams.

Reinforcing rods with a reinforcing stirrup member partially encompassing the transversely arranged rods may be mounted in the beam form area.

In one preferred embodiment, a metal deck is supported in a lower flange area and plywood is supported on an upper flange area of each two adjacent cooperating beam forms. In another preferred embodiment a composite slab may be formed by positioning a metal deck on an upper flange area of the beam form, with a wooden member supported by the lower flange area, which wooden member braces the beam form and gives added support to the metal deck. In both these two preferred embodiments, the beam form has two opposed outwardly extending support means in the form of a stepped flange with two flange areas in different elevations. In a third and fourth embodiment of the invention, a beam form with a single flange is used which is wide enough to provide a first supporting surface area and to support a support member, which in turn provides a second surface area which first and second surface areas may alternately support a metal deck in the forming of a slab. In a broader sense, it is an object of this invention to provide a metal beam form which is simple in design, which is easy to use and remove, and which has means for supporting a metal deck used to form a slab-beam construction.

It is another object of the present invention to provide a metal beam form which projects downwardly in a hanging fashion beneath the level of an adjacent composite slab.

A further object of the present invention is to provide an integral beam form which remains unitary, and which therefore, may be readily reused in successive slab-beam forming operations.

A still further object of the present invention is to provide a design for a metal shoring head of a shoring frame which is complementary and supports a metal beam form.

Yet another object of the present invention is to provide a metal beam form and shoring device which may be arranged to add support to a metal deck along its length. This feature becomes especially advantageous where some composite slab designs may permit longer spans between adjacent beams.

These and other objects of the invention will be more fully understood from the following description of the invention, on reference to the illustrations appended hereto.

DESCRIPTION OF THE PREFERRED EMBODIMENTS

Figure 1:
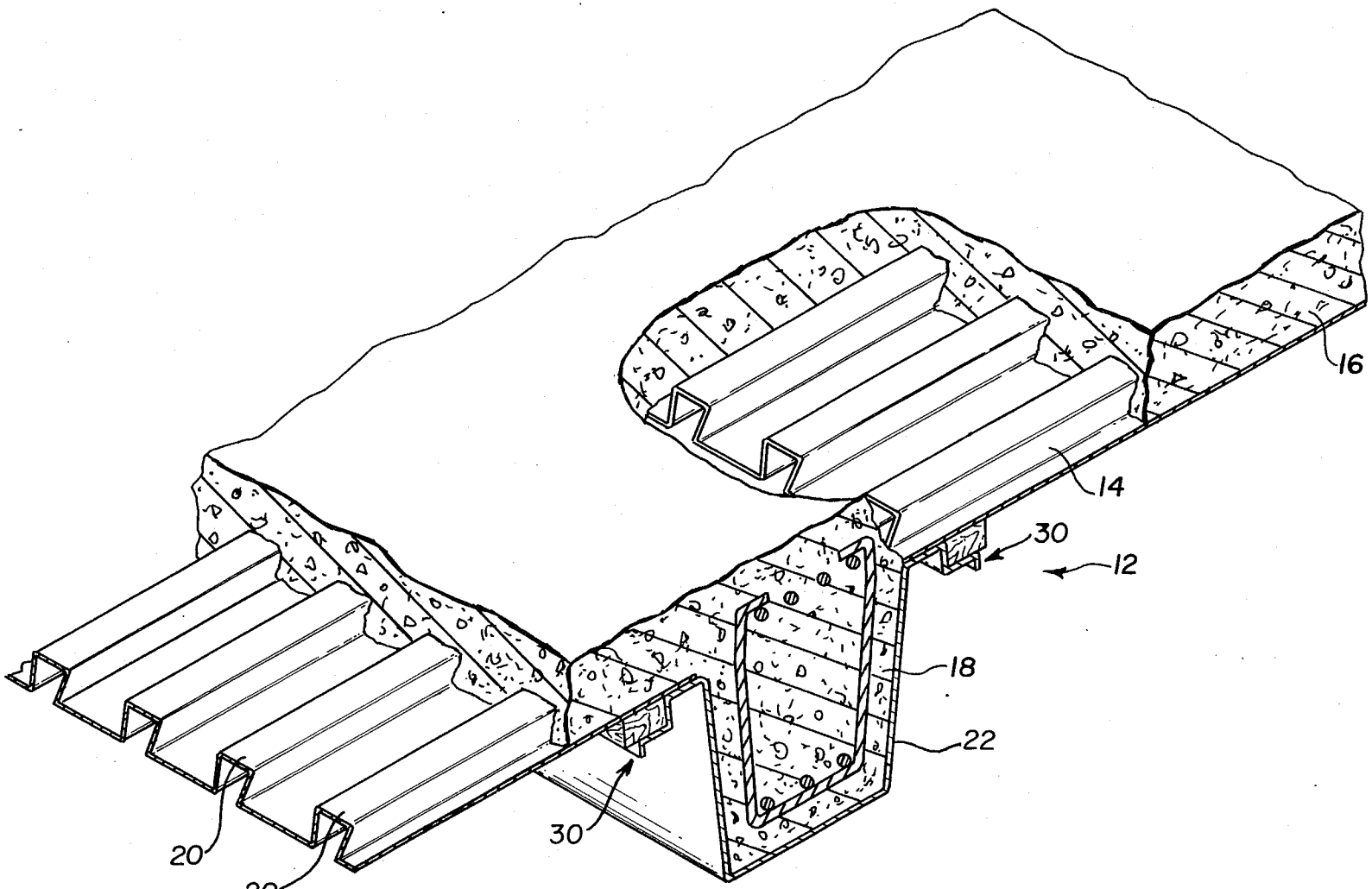
FIG. 1 is a fragmentary perspective view of a section of a composite slab and a beam form of this invention.
Figure 2:
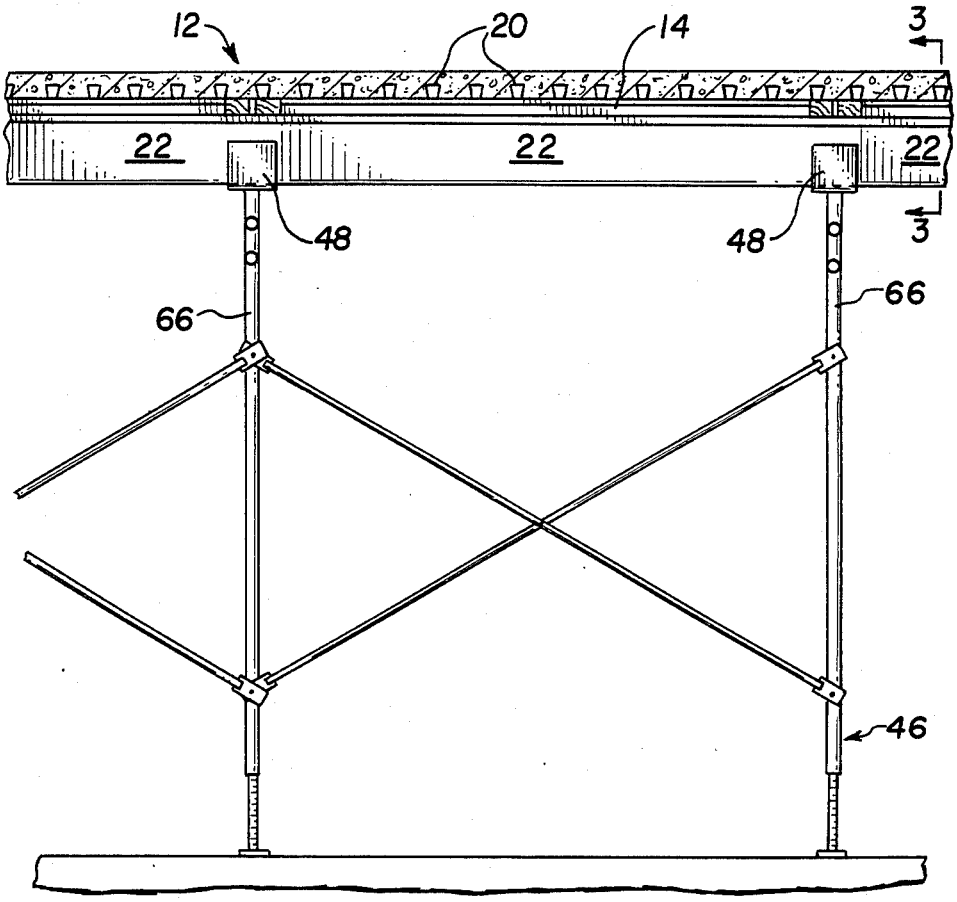
FIG. 2 is a vertical section through a slab-beam system, and is a first preferred embodiment of the present invention.

Referring now to FIG. 1, there is shown a slab-beam construction for a roof or floor formed by a first preferred embodiment of this invention. A composite slab assembly 12 has a corrugated metal deck 14 with an overlying concrete layer 16, and a transversely oriented downwardly depending concrete beam 18 integrally connected to slab assembly 12. As best seen in FIG. 2, metal deck 14 of slab assembly 12 has a plurality of longitudinally oriented hollow ribs 20 (one of which is numbered) disposed in generally parallel spaced relationship with respect to each other, between which ribs concrete is received. This construction for a composite slab may generally follow the teachings of U.S. Pat. No. 3,967,426, which is incorporated herein by reference, and which therefore, will only be discussed with the specificity necessary to understand the present invention.

Generally, the novel aspects of the present invention lie in a construction and use of a metal beam form 22 used in forming a slab-beam construction as best shown in FIGS. 3, 4, 5, 6, 7, and 7*a*.

Figure 3:
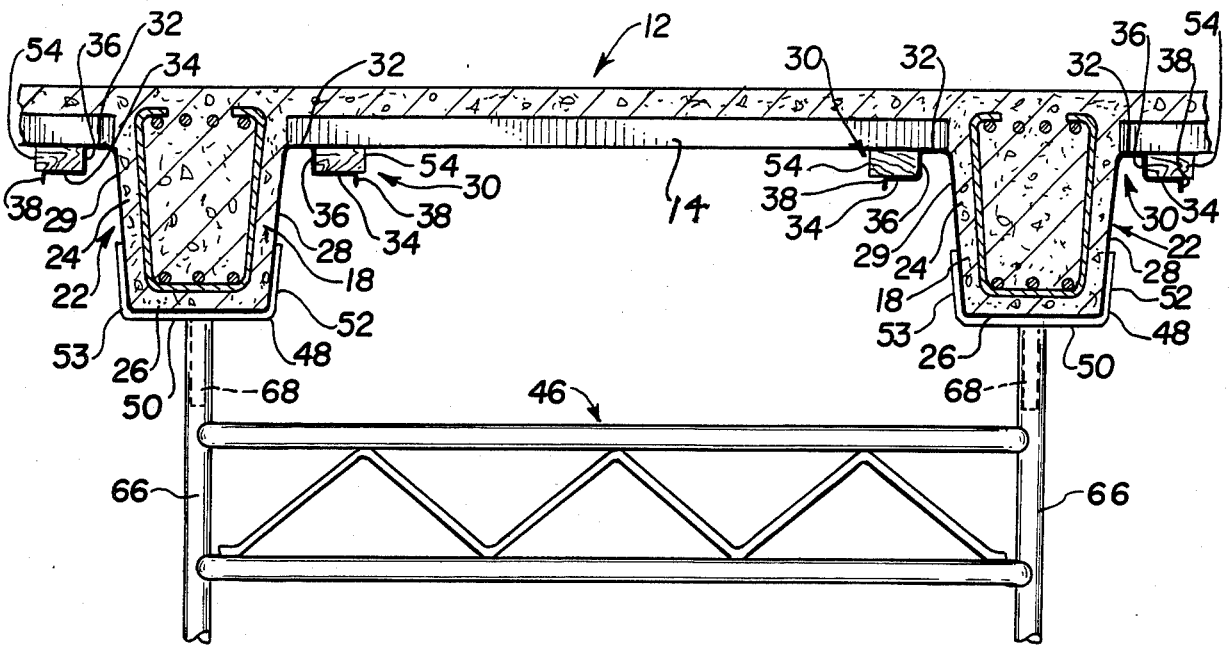
FIG. 3 is a vertical transverse section taken on line 3—3 of FIG. 2, showing a composite slab formed by the present invention.
Figure 4:
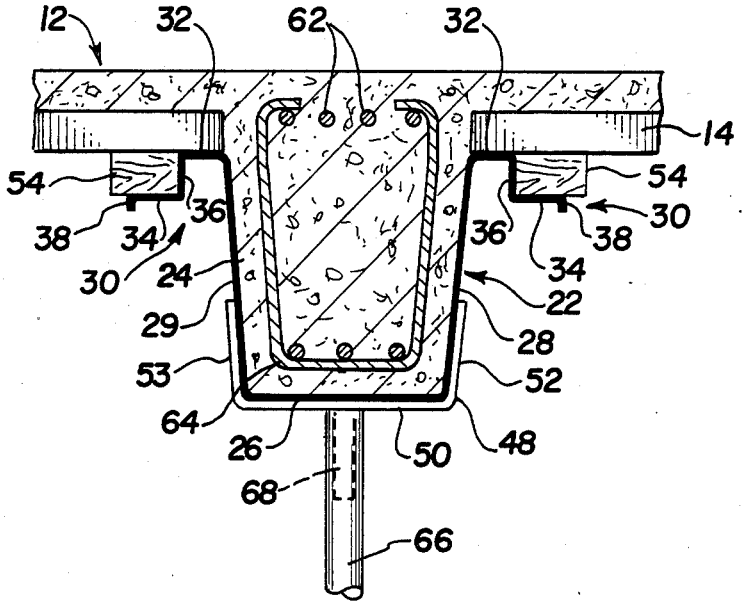
FIG. 4 is partial enlarged view of FIG. 3.
Figure 5:
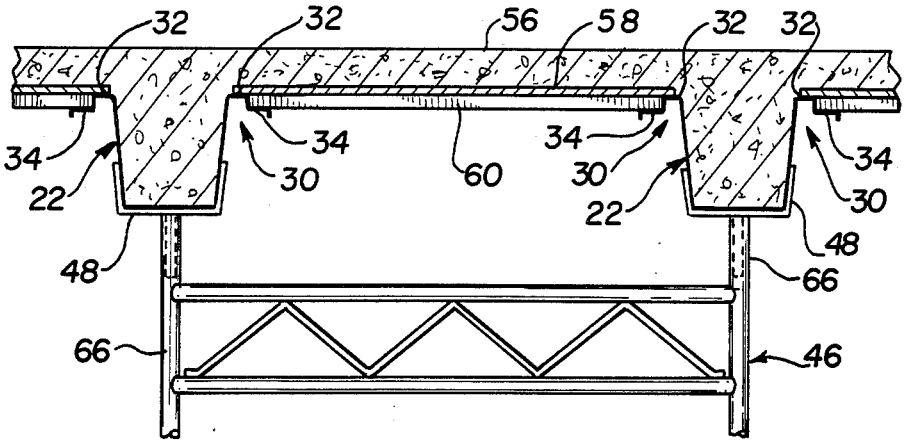
FIG. 5 is a vertical section similar to FIG. 3, but showing a second preferred embodiment of this invention.
Figure 6:
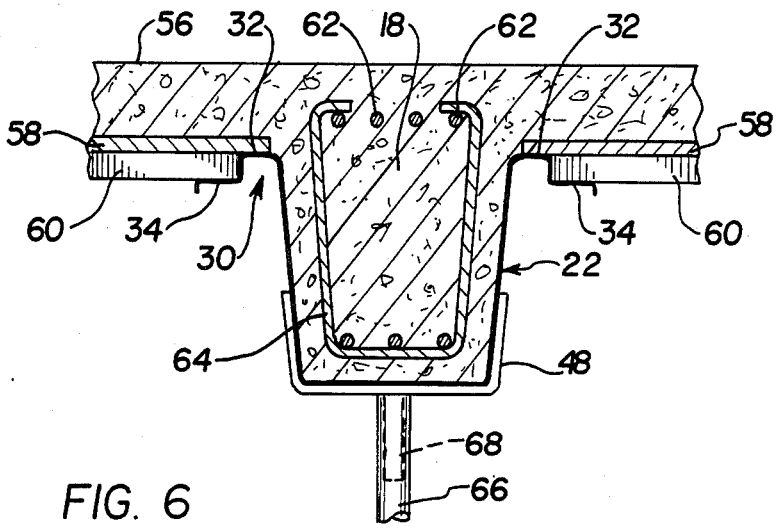
FIG. 6 is a partial, enlarged view of FIG. 5.

As seen in the Figures, FIGS. 4 and 6 illustrate a single beam 18; whereas FIGS. 3 and 5 illustrate two adjacent spaced-apart beams 18 cooperating to support a slab or slab assembly between their span.

The description of beam form 22 will be discussed with particular reference to the two preferred embodiments depicted in FIGS. 3 through 7*a*. It is to be appreciated that differences exist in the particular construction of the slab adjacent the beam form 22, and that the design of beam form 22 is similar throughout FIGS. 3–7*a* even though some of the numbers have been eliminated from FIGS. 5 and 6 for clarity.

Figure 7:
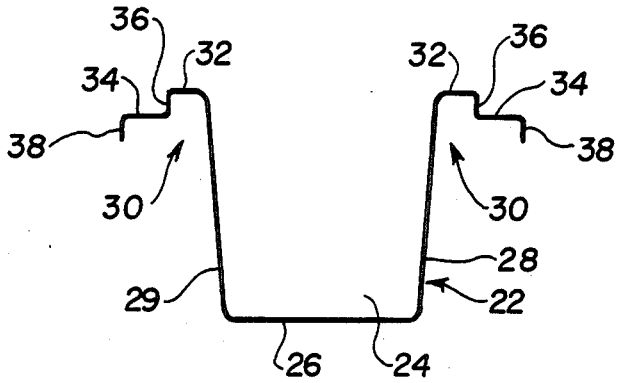
FIG. 7 is an elevational view of a metal beam form of this invention.
Figure 7A:
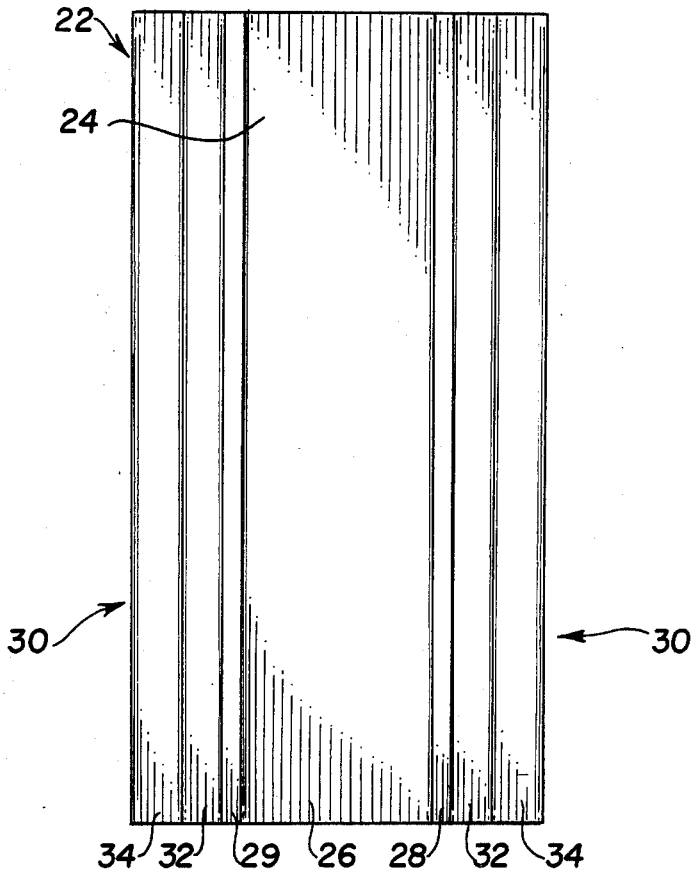
FIG. 7*a* is a plan view of a metal beam form in FIG. 7.

In these FIGS. 3–7*a*, particularly FIGS. 3, 4, and 7, beam form 22 generally comprises a "U" shape channel made of a metal; for example, galvanized steel. In the illustrated form, channel 24 includes a bottom wall 26 and two opposing upstanding sidewalls 28 and 29 integral with bottom wall 26. Sidewalls 28 and 29 are slanted upwardly and outwardly from bottom wall 26 to the top of beam form 22 at an angle preferably from 3° to 8° from the vertical, and are provided at their outer lateral opposed ends with a double stepped flange unit 30 consisting of an upper flange surface area 32, and a lower flange surface area 34. Connecting these two flange areas 32 and 34 is a vertical wall 36, and at the extreme edge of lower flange 34 is a vertical lip portion 38 (best seen in FIGS. 4 and 7). These parts for beam form 22 may be in the form of metal sheets stitch welded together, or beam form 22 may be press formed from a unitary steel flat plate.

In forming a slab-beam construction of the present invention, as FIG. 2 indicates a beam form 22 is arranged in a longitudinal direction and supported by a shoring frame assembly 46. The manner in which the components of this system are arranged may generally follow the practice known in the art.

With particular reference to FIGS. 2, 3, and 4, beam form 22 is supported by a shoring head 48 of shoring frame assembly 46. (FIGS. 2 and 3). Shoring head 48 generally is a "U" shape channel with a bottom wall 50 and two opposed sidewalls 52 and 53 generally slanting upwardly and outwardly at an angle of preferably 3° to 8° from the vertical toward its opening for receiving beam form 22. Shoring head 48 is made of a plate metal, which can be either stitch welded together or integrally formed by a press brake. Shoring head 48 is dimensioned such as to adequately receive and support beam form 22. FIG. 2 shows several shoring heads 48 strategically located to support beam form 22 along its length. The distance between and the number of support locations for beam form 22 along its length may depend on the overall length of the beam form 22 and the type of metal deck used for the slab construction to give the desired load bearing properties for the slab-beam construction, more of which will be discussed shortly.

Referring particularly to FIG. 3, there is shown two opposed beam forms 22 each supported by a shoring head 48 directly contacting beam form 22. Each beam form 22 is illustrated as having a formed concrete beam 18. Between these two adjacent beams 18*a*, composite slab assembly 12 of FIGS. 1, 2, 3, and 4 is formed. The slab-beam construction comprising composite slab 12 is obtained through utilization of double flange unit 30 of beam form 22. In the assemblage of the formwork including the beam form 22 for this slab-beam assembly and prior to the pouring of the concrete and with particular reference to FIG. 3, metal deck 14 is positioned for horizontal support atop upper flange surface area 32 of the double flange unit 30 of two opposing beam form 22. Directly beneath and abutting metal deck 14 is a wooden member 54, extending in a longitudinal direction parallel to the length of beam form 22. Wooden member 54 is substantially supported by vertical wall 36 and lower flange surface area 34, and the thickness of wooden member 54 generally equals the distance between lower flange surface area 34 and surface 32 of the upper flange to provide adequate support to metal deck 14.

As can be seen in FIGS. 3 and 4, this feature of the double flange unit 30 is extremely important in forming a composite concrete slab assembly 12, in that it provides a supporting upper flange area 32 which allows the metal deck 14 to become an integral part of the slab formed between the two beam forms 22 (FIG. 3), while still providing support for the metal deck 14.

While this first embodiment has particularly been explained with regard to two spaced-apart beam forms 22, it is to be understood that only one beam form 22 may be used wherein a composite slab 12 is still formed transversely to the concrete beam 18 as shown, for example, in FIG. 4.

A second preferred embodiment for a slab-beam construction is shown in FIGS. 5 and 6. As mentioned earlier, some numbers have been eliminated in these FIGS. 5 and 6; however, the same elements are contained herein. The main difference is in the slab-beam construction, with the design for the beam form 22 and shoring frame 46 being similar to the first embodiment. This embodiment is generally used to form a concrete slab, which is generally understood in the art as not being of a composite structure, in that it does not contain a reinforcement metal deck similar to that of the first embodiment. In forming this concrete slab 56, a generally flat sheet of plywood 58 is arranged to be supported by upper flange surface area 32 and a corrugated metal deck 60 is arranged to be supported by the lower flange surface area 34 of the double flange units 30 of the two opposing beam forms 22. (FIGS. 5 and 6). During the disassembling of the formwork, both plywood 58 and metal deck 60 are easily removed from the formed hardened concrete slab 56, along with beam forms 22.

Removal of metal beam forms 22, from the formed concrete beam 18 of both embodiments, and of plywood 58 of the second embodiment is easily accomplished by applying a film of lubricant prior to use, which practice is well known in the art.

Lip portion 38 of the lower surface flange 34 of flange unit 30 may be used in the removal stage of beam form 22 from the hardened concrete beam 18, whereby this lip 38 can be pulled away from either deck 60 in FIG. 6 or member 54 in FIG. 4.

In both embodiments reinforcement of the concrete beams 18 is done through utilization of reinforcing rods 62 and stirrup member 64 partially encompassing rods 62. (FIGS. 4 and 6). These elements 62 and 64 are mounted and arranged in the beam form 22 during the erection phase of the formwork for the slab-beam assembly.

The shoring frame assembly 46 shown in FIGS. 2, 3, and 5, carries shoring head 48 by an upright member 66, upon which shoring head rests. In upright member 66 is an adjustment screw 68, which upon operation raises or lowers shoring head 48 to obtain the desired level for beam form 22. This screw arrangement for shoring head 48 is a standard part of the shoring frame assembly 46, and well known in the art.

Figure 8A:
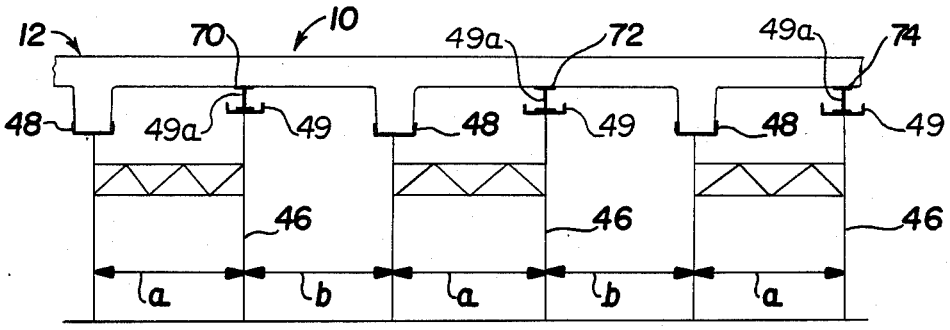
FIG. 8*a* is a schematic view illustrating the support points for a shoring frame of the first embodiment.
Figure 8B:
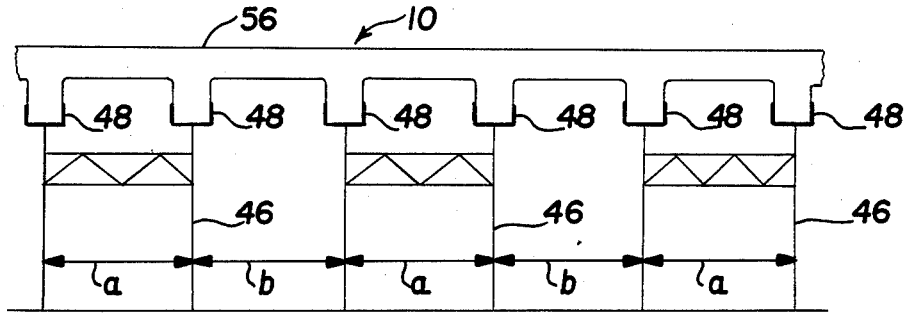
FIG. 8*b* is a schematic view illustrating the support points for a shoring frame of the second embodiment.

FIGS. 8*a* and 8*b* show a schematic representation of a fixed beam spacing between slabs in a slab-beam arrangement 10. This beam spacing is fixed by the positioning of shoring frame assembly 46 and the location of the shoring heads 48, 49 on the shoring frame 46; the shoring heads 48 being designed according to the teachings of the invention and the shoring heads 49 being a standard design well known in the art. For example, the distance "a" between shoring heads may be approximately five feet, and the distance "b" between the several frame assemblies 46 may be approximately five feet. These distances "a" and "b" may be fixed in the preconstruction phase for the slab-beam construction.

The composite slab assembly 12 of the first embodiment generally allows longer length slabs to be formed between beams 18, which then require a greater distance between the beam forms as shown for example in FIG. 8*a*; as compared for example in FIG. 8*b* relating more to shorter length slabs of the second embodiment.

As can be seen in FIG. 8*a*, this invention accommodates the longer spanned slabs with the fixed locations of shoring heads 48, 49 using an "I" beam 49*a* with a standard shoring head 49 as shown at 70, 72, and 74 on upright member 66, thereby providing adequate support means intermediately along the length of the composite slab 12. This provision allows the required adaptability necessary to accommodate various dimensions of the available space; for example, in rooms.

As mentioned, the arrangement of FIG. 8*a* may generally be used for long length slabs 12 such as that of the first embodiment, and FIG. 8*b* generally lends itself to shorter slabs 56 such as that identified in the second embodiment. Also, in some applications, the standard shoring head 49 may be replaced by the shoring head 48 of the invention.

The operation of the first two embodiments mentioned above has already been described in some detail in the above description, and therefore, will be only briefly reiterated. Beam form 22 is lubricated along with plywood 58 of the second embodiment. In the first embodiment, the wooden members 54 are positioned on the lower flange 34 and metal deck 14 is positioned on upper flange 32 (FIGS. 3 and 4). In the second embodiment of FIGS. 5 and 6, metal deck 60 with plyform 58 are positioned onto flange unit 30 with deck 60 on lower flange and plywood 58 on upper flange 32. Prior to this step, the shoring frame 46 is erected on a grid of approximately five feet by five feet, and the shoring heads 48 are placed on upright member 66 of shoring frame 46. A metal beam form 22 is placed down into shorehead 48. The entire slab-beam system may be leveled at this time by using the adjustment screw 68 in each shore head 48. With the metal deck 14 and the metal deck 60 in their respective supporting flanges, and the reinforcing rods 62 and stirrups 64 arranged in the beam area, the concrete is poured into the formwork for the slab-beam assembly. After the concrete is sufficiently cured, screws 68 lower the shoring head 48, and beam form 22 is removed, and prepared for future use, if desired. In some instances, flange units 30 of beam form 22 may be fastened to the wooden members 54 of FIG. 4 or the structural deck 60 of FIG. 6. Removal of beam form from the formed concrete slab is easily facilitated through lip 38 (FIG. 7) which may be pulled away from the formed slab.

Figure 9:
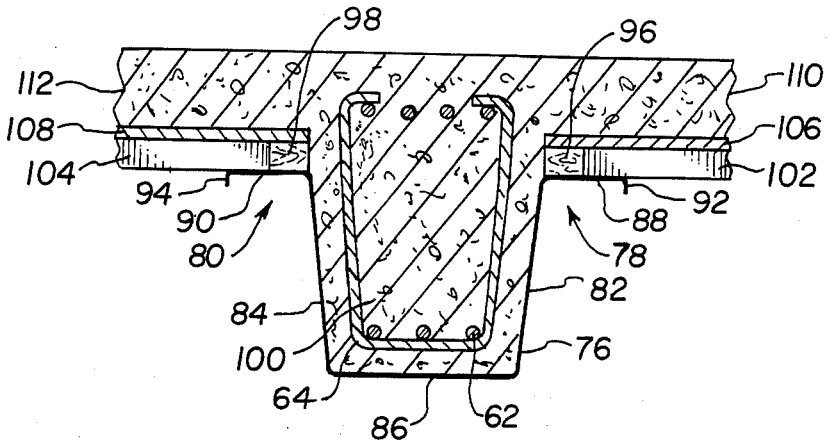
FIG. 9 is a vertical section similar to FIG. 3, and showing a third preferred embodiment of this invention.
Figure 10:
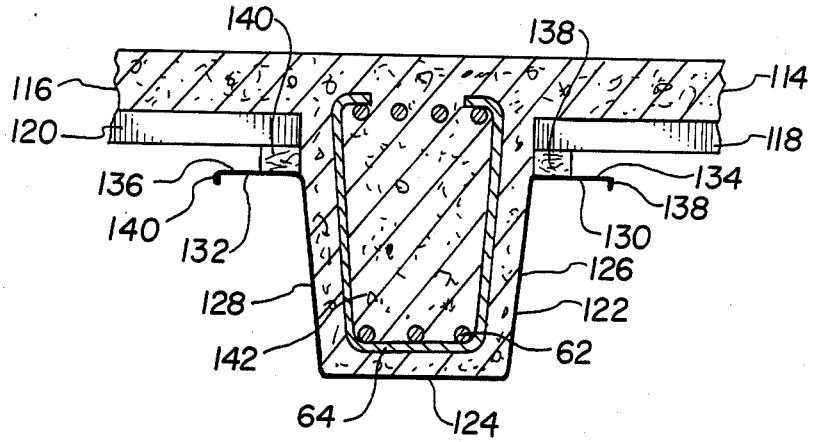
FIG. 10 is a vertical section similar to FIG. 3, and showing a fourth preferred embodiment of this invention.

FIGS. 9 and 10 illustrate a third and a fourth embodiment, respectively. As shown in FIG. 9, a metal beam form 76 has two laterally opposed generally horizontal flange units 78 and 80 extending outwardly from an opposed sidewall 82 and 84 respectively, connected to a bottom wall 86, the two opposed sidewalls 82 and 84 generally slanting upwardly and outwardly at an angle of preferably 3° to 8°. Each flange unit 78 and 80 has a horizontal surface area 88, 90 and a vertical lip 92, 94 extending downwardly at the extreme end of the surface area 88, 90. A support member 96, 98 is supported by surface area 88, 90 and arranged to the side thereof nearest the formed beam 100. Also supported on surface area 88, 90 is a metal deck, 102, 104, which horizontally extends over a neighboring beam form (not shown). Plywood 106, 108 is arranged on top of both support member 96, 98 and metal deck 102, 104 and extends with the metal deck 102, 104 across the span to be supported by the neighboring beam form. In this embodiment, a concrete slab 110, 112 and a concrete beam 100 is formed similar to that of the second embodiment of FIGS. 5 and 6, in that the plywood 106, 108 and metal deck 102, 104 ultimately are removed, thereby not becoming part of the slab-beam system.

The fourth embodiment of FIG. 10 is similar to that of the first embodiment in that a composite slab 114, 116, is formed, i.e. metal corrugated deck 118, 120 becomes an integral part of the slab. As shown in this FIG. 10, metal beam form 122 has a bottom wall 124, and two opposed sidewalls 126 and 128. Extending outwardly in a generally horizontal plane are two laterally opposed flange units 130 and 132, each having a horizontal surface area 134, 136 and vertical lip 138, 140 extending downwardly at an extreme end of the surface area 134, 136. Supported on surface area 134, 136 is a support member 138, 140 located nearest the formed beam 142.

The general arrangement of elements described hereto of FIG. 10 is similar to that of FIG. 9. The main difference is that a corrugated metal deck 118, 120 is supported on top support member 138, 140 to become a composite slab 114, 120 in the concrete pouring stage.

In both embodiments of FIGS. 9 and 10, the support members 138 and 140 may be wooden 2×4's, which may be attached to the flange units 130 and 132 in a pre-assembly stage of the slab-beam form system by fastening means, such as screws. In the assembling stage, the beam forms 76 and 122 are supported by a shoring head of a shoring frame assembly similar to that described previously herein.

Referring to FIG. 9, and still referring to the assembly stage for the slab-beam form system, metal deck 102, 104 is placed on the supporting surface 88, 90 of flange unit 78, 80 of two neighboring cooperative beam forms 76, followed by plywood 106, 108 being placed on support member 96, 98 of two cooperative beam forms. Plywood 106, 108 may be fastened in place by fastening means, such as nails, which can be easily pried loose in the disassembling of the slab-beam form system. With the reinforcing bars 62 and stirrup member 64 in position, the concrete is poured and allowed to harden. In the disassembling stage, plywood 106, 108 may or may not be removed along with the metal deck 102, 104; support member 96, 98; and beam form 76. Referring to FIG. 10, in the assembly stage corrugated metal deck 118, 120 is placed on support member 138, 140 of flange units 130, 132 of the two opposed cooperative beam forms 122 and fastened thereto by fastening means, such as nails.

A slab-beam system as particularly shown in FIGS. 9 and 10, may, for example form a slab approximately four inches in depth from the top of the slab 114, 116 down to the top of support member 138, 140. The beam may be approximately ten inches wide and ten to twelve inches deep. Flange supporting surface 134, 136 is approximately five inches wide with support member 138, 140 being approximately 3 to 4 inches wide and approximately 2 inches deep. The metal deck 102, 104 and plywood 106, 108 of FIG. 9 measures approximately 1.5 inches for the deck and $\frac{5}{8}''$ for the plywood, and the corrugated metal deck 118, 120 of FIG. 10 measures approximately 2" deep.

Lip member 92, 94, 136, 138 extending down from support surface 88, 90, 134, 136 can be used to pull beam form 76, 122 away from the formed slab-beam system in the removal of the slab-beam form upon setting and hardening of the concrete. Several advantages arise out of support member 96, 98, 138, 140 being pre-attached to flange unit 78, 80, 130, 132 of FIGS. 9 and 10; these advantages being, (1) less labor in the field in assembling the system; (2) it provides means for which metal deck or corrugated metal deck can be secured; and (3) it adds strength and rigidity to the flange unit 78, 80, 130, 132 on the beam form 76 and 122.

For added support to support member 96, 98, 138, 140 of FIGS. 9 and 10, the sidewalls 82, 84, 126 and 128 of each beam form 76, 122 in FIGS. 9 and 10 can be made to extended upwardly beyond the flange unit 18, 80, 130, 132, thereby forming an abutting wall surface for support member 96, 98, 138, 140.

While for purposes of illustration specific forms of the metal beam form and the shoring head have been shown, it will be appreciated that the advantageous features of this invention are not so limited and modifications thereof will be apparent to one skilled in the art.

Whereas particular embodiments of the invention have been described above for purposes of illustration, it will be evident to those skilled in the art that numerous variations of the details may be made without departing from the invention as defined by the appended claims.

I claim:

1. In a slab-beam formwork system for receiving poured concrete in the constructing of a roof or floor, comprising:

a generally U-shape channel form adapted to form a concrete beam for said system and having an outwardly extending support means extending generally in a horizontal plane and being part of at least one sidewall of said channel form adjacent an opening for said receiving of said poured concrete, said support means consisting of at least two generally horizontal support areas, one said area being on an upper elevational level in close proximity to said opening of said channel form and the other of said area being on a lower elevational level remote from said opening of said channel form, each of said areas adapted to support a structural member for the forming of said slab, and said areas having means adapted to alternately support said structional member in the pouring of said concrete whereby said structural member is positionable on said one area on said upper elevational level to become a composite part of said slab, or said structural member is positionable on said other area on said lower elevational level to be removed after the forming of said slab.

2. The slab-beam formwork system of claim 1, wherein said channel form is metal and further comprising means associated with said support means including lip means extending downwardly from said other area is said lower elevational level for easy removal of said channel form from said formwork and said formed slab and beam.

3. The slab-beam forming system of claim 1, wherein said structional member is a corrugated metal deck located on said one area on said upper elevational level, and further comprising a support member supported by said other area in said lower elevational level, and adapted to substantially support said metal deck and to be removed from said formwork.

4. The slab-beam forming system of claim 1, wherein said structural member is a metal deck located on said other area on said lower level, and further comprising a support member supported by said one area in said upper elevational level, and adapted to be substantially supported by said metal deck and to be removed along with said metal deck after the forming of said slab and beam.

5. The slab-beam formwork system of claim 1, further comprising a shoring system adapted to support said formwork of said slab-beam system, said shoring system consisting of a frame having at least and a plurality of upright members, and a U-shape shoring head connected to each said upright member, and said U-shape shoring heads each adapted to substantially support said channel form along the length of said channel form.

6. The slab-beam formwork system of claim 5, wherein said shoring system further comprises adjustable means for adjusting the elevational level of said each shoring head, and wherein said channel form consists of a bottom wall and two opposed sidewalls generally slanting upwardly and outwardly from said bottom wall, and wherein said shoring head consists of a bottom wall and two opposed sidewalls generally slanting upwardly and outwardly from said bottom wall at an angle generally corresponding to said sidewalls of said channel form.

7. The slab-beam formwork system of claim 5, wherein a plurality of concrete beams and slabs are alternately formed and, wherein said shoring heads substantially extend the length and width of said slab-beam formwork, said shoring system further comprising means for selectively adapting said shoring heads in a manner that substantial support is given to said slab when a longer length slab is formed in said slab-beam system.

8. A method of forming a concrete slab-beam system for a roof or floor with a formwork, the steps comprising:

providing a generally U-shape channel form with an opening for receiving concrete and having outwardly extending flange means with at least two supporting surfaces with one surface in an upper elevational level and adjacent to said opening, and another surface in a lower elevational level away from said opening and in the step for forming a composite slab consisting of a metal deck integrally cast with said concrete, positioning said metal deck onto said one surface in said upper elevational level of cooperative flange units of two neighboring cooperative channel forms.

9. A method of claim 8, the steps further comprising:

prior to said positioning of said metal deck onto said one surface, further positioning a support member which is to be removed for said metal deck onto said another surface in said lower elevational level of cooperative flange means of said two neighboring cooperative channel forms, and pouring said concrete onto said metal deck and into said opposed channel forms.

10. A method of claim 9, the steps further comprising:

after the pouring of said concrete onto said metal deck and into said channel form and when said concrete is sufficiently hardened, removing at least said two cooperative channel forms and their said support member from said formed slab-beam system.

11. A method of claim 8, wherein said slab-beam system has a shoring frame system for supporting said formwork thereof, the steps further comprising:

providing a plurality of generally U-shape shoring heads for supporting said each beam channel form along its length, and in the instance where added support is needed for a longer length slab between said cooperative channel forms, using a shoring head and adjusting it to substantially support said slab in its forming process at a location between said neighboring beam channel forms.

12. A method of forming a concrete slab-beam system for a roof or floor with a formwork, the steps comprising:

providing a generally U-shape channel form for forming said beam, and having an opening for receiving concrete and outwardly extending flange means having at least two supporting surfaces with one surface in an upper elevational level adjacent to said opening, and another surface in a lower elevational level away from said opening, and in the step for forming a concrete slab, positioning a support member which is to be removed onto said one surface in said upper elevational level of cooperative flange means on two neighboring cooperative channel forms.

13. A method of claim 12, the steps further comprising:

prior to said positioning of said support member onto said one surface, further positioning a structural member which is to be removed onto said another surface of cooperative flange means of said two neighboring channel forms, and pouring said concrete onto said support member and into said opposed channel forms.

14. A method of claim 13, the steps further comprising:

after the concrete has sufficiently hardened, removing said channel forms, said structural member, and said support member from said formed slab-beam system.

15. A method of claim 12, wherein said slab-beam system has a shoring frame for supporting said formwork thereof, the steps further comprising:

providing a plurality of generally U-shape shoring heads for supporting said each beam channel form along its length, and in the instance where added support is needed for a longer length slab, using a shoring head and adjusting it to substantially support said slab along its length in its forming process at a location between said neighboring beam channel forms.

16. A beam form for receiving poured materials such as concrete or the like to form a beam upon solidification of said material, comprising:

a generally U-shape unitary metal channel with a bottom wall and two opposing sidewalls extending upwardly and outwardly from said bottom wall to form an opening for said receiving of said material, stepped flange means associated with at least one said sidewall generally laterally disposed relative thereto and consisting of at least two supporting surfaces, one of said two surfaces of said flange means being on an upper elevational level in close proximity to said opening and the other of said surfaces being on a lower elevational level remote from said opening of said channel, each of said surfaces having means adapted to horizontally and alternately support a member whereby said member either becomes an extension of said formed beam upon said member being supported on said one of said two surfaces; or said member is removable with said beam form after the forming of said beam.

17. The beam form of claim 16, wherein said two opposing sidewalls extend upwardly at an angle in the range generally of 3° to 8°, and further comprising lip means associated with said other of said surfaces in said lower elevational level of said flange means adapted to easily remove said base form from said solidified beam.

* * * * *

UNITED STATES PATENT AND TRADEMARK OFFICE

CERTIFICATE OF CORRECTION

PATENT NO. : 4,685,264

DATED : August 11, 1987

INVENTOR(S) : DONALD H. LANDIS

It is certified that error appears in the above-identified patent and that said Letters Patent is hereby corrected as shown below:

Column 2, line 20, "disassemling" should be --disassembling--.

Claim 1, column 9, line 6, "structional" should be --structural--.

Claim 3, column 9, line 21, "structional" should be --structural--.

Claim 5, column 9, lines 38-39, "at least and" should be deleted.

Claim 17, column 12, line 21, "base" should read --beam--.

Signed and Sealed this

Sixteenth Day of February, 1988

*Attest:*

*Attesting Officer*

DONALD J. QUIGG

*Commissioner of Patents and Trademarks*